US005613676A

United States Patent [19]

Connolly

[11] Patent Number: 5,613,676

[45] Date of Patent: Mar. 25, 1997

[54] SPORTING NET

[76] Inventor: Thomas M. Connolly, 100 No Hingham Rd., Bedford Hills, N.Y. 10507

[21] Appl. No.: 625,247

[22] Filed: Apr. 1, 1996

[51] Int. Cl.[6] ..... A63B 63/08; A63B 71/02

[52] U.S. Cl. ..... 473/416; 273/127 B; 273/400

[58] Field of Search ..... 273/15 R, 400, 273/127 B

[56] References Cited

U.S. PATENT DOCUMENTS

| | | | |
|---|---|---|---|
| 3,602,504 | 8/1971 | Chapman | 273/1.5 R |
| 4,307,887 | 12/1981 | Weiss | 273/1.5 R X |
| 4,762,319 | 8/1988 | Krumholz | 273/1.5 R |
| 4,786,053 | 11/1988 | Barnes, Jr. | 273/1.5 R |
| 4,940,232 | 7/1990 | Chen | 273/1.5 R |
| 5,372,368 | 12/1994 | Pavonetti | 273/127 B X |

FOREIGN PATENT DOCUMENTS

| | | | |
|---|---|---|---|
| 2636659 | 3/1990 | France | 273/127 B |

OTHER PUBLICATIONS

KBA, Basketball Coaching and Training Aids 1989 School Mail Order Catalog, p. 33, Portable adjustable basketball & game standard Dec. 1988.

*Primary Examiner*—Paul E. Shapiro

[57] ABSTRACT

A sporting net which can be utilized either as a hockey net or a basketball hoop. The apparatus includes a center post having a basketball hoop and its upper end. Furthermore, two linkages are pivotally secured at opposing locations at the intermediate extent of the center post. A hockey net is secured in between these two linkages. In order to facilitate storage of the sporting net, the linkages are pivotal between a first use orientation, wherein they extend laterally from the post then downwardly to abut a recipient surface and a second storage orientation wherein they are positioned generally next to the post.

4 Claims, 3 Drawing Sheets

SPORTING NET

BACKGROUND OF THE INVENTION

1. Field of the Invention

The present invention relates to sporting net and more particularly pertains to a net which enabling the use of the net with two sports.

2. Description of the Prior Art

The use of sport nets is known in the prior art. More specifically, sport nets heretofore devised and utilized for the purpose of catching sports balls are known to consist basically of familiar, expected, and obvious structural configurations, notwithstanding the myriad of designs encompassed by the crowded prior art which has been developed for the fulfillment of countless objectives and requirements.

U.S. Pat. No. 4,786,053 to Barnes, Jr. discloses a portable free-standing apparatus for multiple athletic ball games. U.S. Pat. No. 4,762,319 to Krumholz discloses a convertible sports stand construction. U.S. Pat. No. Des. 340,486 to Rothbard discloses a basketball net. U.S. Pat. No. 4,492,380 to Saytar discloses an arena type game. U.S. Pat. No. 5,348,309 to Queiros discloses a sport net. Furthermore, U.S. Pat. No. 5,207,433 to Moore discloses a football game apparatus and method of play.

In this respect, the sporting net according to the present invention substantially departs from the conventional concepts and designs of the prior art, and in doing so provides an apparatus primarily developed for the purpose of enabling the use of the net with two sports.

Therefore, it can be appreciated that there exists a continuing need for new and improved sporting net which can be used with two sports. In this regard, the present invention substantially fulfills this need.

SUMMARY OF THE INVENTION

In view of the foregoing disadvantages inherent in the known types of sport nets now present in the prior art, the present invention provides an improved sporting net. As such, the general purpose of the present invention, which will be described subsequently in greater detail, is to provide a new and improved sporting net and method which has all the advantages of the prior art and none of the disadvantages.

To attain this, the present invention essentially comprises a sporting net for use in conjunction with both basketball and hockey. The net employs a center post defined by an upper extent with an upper end, and a lower extent with a lower end. The upper extent is telescopically received within the lower extent to afford adjustability to the center post. The upper end includes approximately a 90 degree bend, and the lower end includes a weighed base portion. Furthermore, two opposed resilient clips are positioned intermediate the upper and lower ends of this center post. A backboard is included at the upper end of the center post. This backboard is defined by a front face and a rear face, and has a basketball net secured to its front face. The rear face of this backboard is secured to the upper end of the center post. The sporting net further includes a first and a second linkage. Each of these linkages includes a first link having two parallel extents and an intermediate perpendicular extent therebetween, and a second downwardly extending link, and a third ground engaging link having a distal end. The first link is pivotally secured to the second link and the second link is pivotally secured to the third link. The first link of the first linkage is pivotally secured to the center post below the opposing clips, and the first link of the second linkage is pivotally secured to the center post below the opposing clips and opposite the first link of the first linkage. Furthermore, a net is secured in between the first and second linkages. Each linkage has a first orientation wherein the first link is approximately perpendicular to the center post and the third link engages the ground with the distal end of the third linkage positioned beneath the weighted base, and a second orientation wherein the first link is secured to one of the opposed clips and approximately parallel to the center post.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved sporting net which have all the advantages of the prior art port nets and none of the disadvantages.

It is another object of the present invention to provide new and improved sporting net which may be easily and efficiently manufactured and marketed.

It is further object of the present invention to provide new and improved sporting net which are of durable and reliable constructions.

An even further object of the present invention is to provide new and improved sporting net which are susceptible of a low cost of manufacture with regard to both materials and labor, and which accordingly are then susceptible of low prices of sale to the consuming public, thereby making such sporting net economically available to the buying public.

Still yet another object of the present invention is to provide new and improved sporting net which provide in the apparatuses and methods of the prior art some of the advantages thereof, while simultaneously overcoming some of the disadvantages normally associated therewith.

Even still another object of the present invention is to enabling the use of the net with two sports.

Lastly, it is an object of the present invention to provide new and improved a dual use sporting net. More specifically, the present invention relates to a sporting net which can be utilized either as a hockey net or a basketball hoop. In its broadest context, the present invention includes a center post having a basketball hoop and its upper end. Furthermore, two linkages are pivotally secured at opposing locations at the intermediate extent of the center post. A hockey net is secured in between these two linkages. In order to facilitate storage of the sporting net, the linkages have a first use orientation, and a second storage orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figures 1, 2:
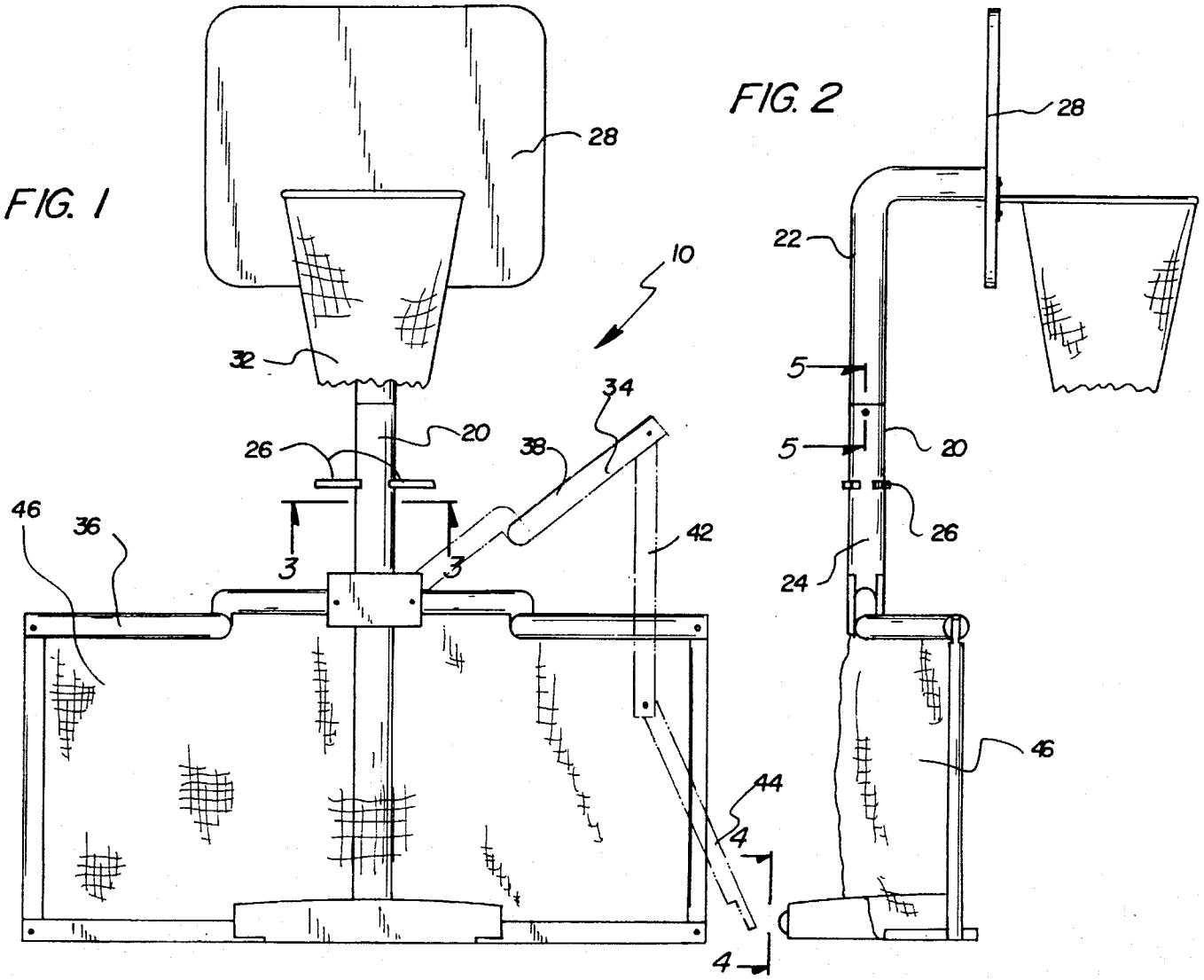
FIG. 1 is an elevational view of the preferred embodiment of the sporting net constructed in accordance with the principles of the present invention.
FIG. 2 is a side view of the sporting net in accordance with the present invention.

With reference now to the drawings, and in particular to FIG. 1 thereof, the preferred embodiment of the new and improved sporting net embodying the principles and concepts of the present invention and generally designated by the reference numeral 10 will be described.

The present invention relates to a dual use sporting net. More specifically, the present invention relates to a sporting net which can be utilized either as a hockey net 46 or a basketball hoop. In its broadest context, the present invention includes a center post 20 having a basketball hoop and its upper end. Furthermore, two linkages are pivotally secured at opposing locations at the intermediate extent of the center post 20. A hockey net 46 is secured in between these two linkages. In order to facilitate storage of the sporting net, the linkages have a first use orientation, and a second storage orientation. The various components of the present invention, and the manner in which they interrelate will be described in greater detail hereinafter.

Figure 5:
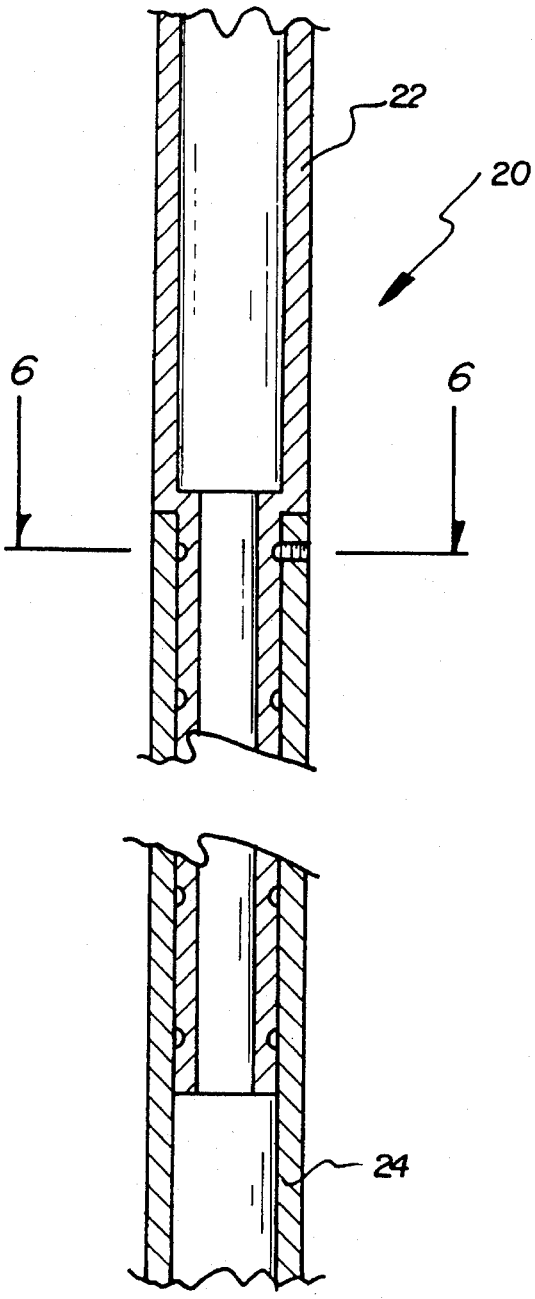
FIG. 5 is a view taken along line 5—5 of FIG. 2.
Figure 6:
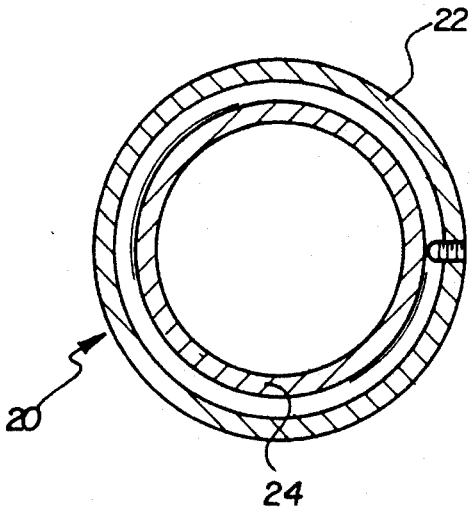
FIG. 6 is a view taken along line 6—6 of FIG. 5.

The major structural component of the dual use sporting net is the center post 20. The center post 20 is defined by an upper extent 22 with an upper end, and a lower extent 24 with a lower end. The upper extent 22 is telescopically received within the lower extent 24 to afford adjustability to the center post 20 and to the sporting net in general. This telescopic arrangement is achieved by the distal end of the upper extent 22 being inwardly stepped to allow its insertion within the lower extent 24 of the center post 20. This arrangement can most clearly be seen in reference to FIG. 5. Furthermore, the stepped portion includes apertures into which one or more pin are inserted to secure the two extents to one another. The telescopic arrangement of the two extents also allows for the rotation of the upper extent 22 relative to the lower extent 24. Thus, with reference to FIG. 2, the basketball hoop can be rotated relative to the hockey net 46. Thus, the two goals can be used simultaneously from two different sides.

Figure 3:
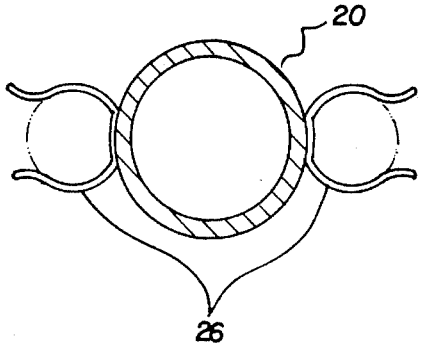
FIG. 3 is a view taken along line 3—3 of FIG. 1.
Figure 4:
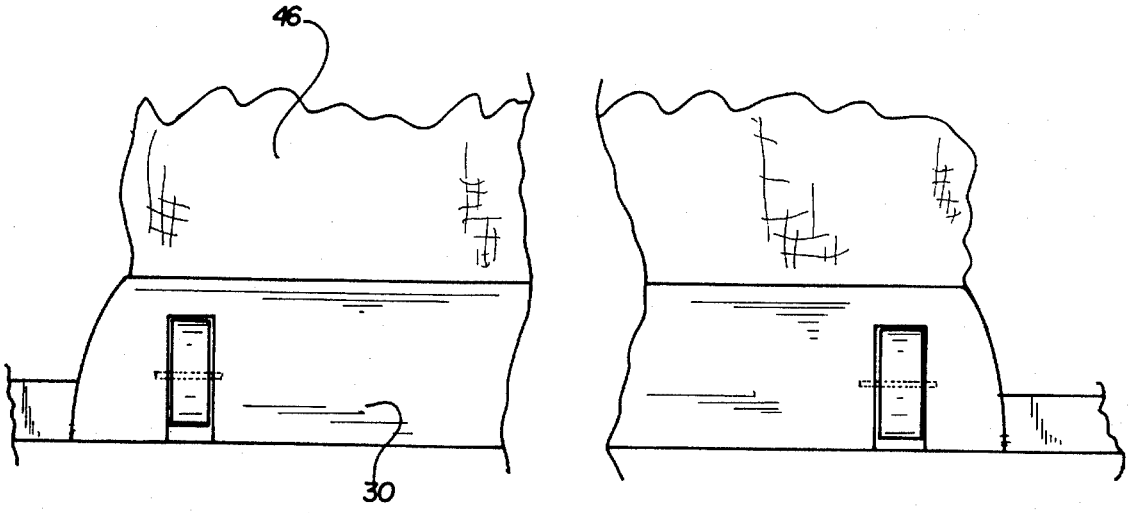
FIG. 4 is a view taken along line 4—4 of FIG. 1.

Turning now to FIG. 2, the upper end of the upper extent 22 has approximately a 90 degree bend. This bend facilitates the use of the basketball hoop. The lower end of the central post includes a weighed base portion 30 to prevent any tipping of the sporting net. The weighted base portion 30 is dimensioned such that it does not interfere with the operation of either the basketball net 32 or the hockey goal. Additionally, to aid in the transport of the device, a set of recessed wheels are positioned at the back of the weighted base 30. These wheels can be seen in reference to FIG. 4. Two opposed resilient clips 26 are positioned intermediate the upper and lower ends of the center post 20. These opposed resilient clips 26 can be seen in reference to FIGS. 1 and 3. The clips 26 are positioned opposite from one another and are constructed of a material which affords their expansion and retraction. The function of these two resilient clips 26 will be described in greater detail hereinafter.

The basketball hoop portion of the sporting goal consists of a backboard 28 defined by a front face and a rear face. Additionally, a basketball net 32 is secured to the front face of the backboard 28. The rear face of the backboard 28 is secured to the upper end of the center post 20. The exact dimensions of the hoop can vary, however, in the preferred embodiment the hoop is of regulation size.

The hockey net 46 portion of the sporting goal is supported by way of a first and a second linkage 36. Each of these linkages is the same, consequently only one of the linkages will be described in detail. Each linkage includes a first link 38 defined by two parallel extents and an intermediate perpendicular extent therebetween. Additionally, each linkage includes a second downwardly extending link 42, and a third ground engaging link 44 having a distal end. Furthermore, in each linkage, the first link 38 is pivotally secured to the second link and the second link is, in turn, pivotally secured to the third link. The manner by which each linkage is secured to the center post 20 will now be described. The first link 38 of the first linkage 34 is pivotally secured to the center post 20 below the opposing clips 26, while the first link 38 of the second linkage 36 is pivotally secured to the center post 20 below the opposing clips 26 and opposite the first link 38 of the first linkage 34. This arrangement can most clearly be seen in reference to FIG. 1. As indicated previously, a hockey net 46 is secured in between the first and second linkages. Each linkage has a first orientation wherein the first link 38 is approximately perpendicular to the center post 20 and the third link engages the ground with the distal end of the third linkage positioned beneath the weighted base. Alternatively each linkage has a second orientation, wherein the first link 38 is secured to one of the opposed clips 26 and approximately parallel to the center post 20. The first orientation can be seen in solid lines in FIG. 1, while the second orientation can be seen in phantom in FIG. 1. Thus, the first orientation constitutes a use orientation, and the second orientation constitutes a storage orientation.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A sporting net for use in conjunction with both basketball and hockey, the net comprising in combination:

a center post having an upper extent with an upper end and a lower extent with a lower end, the upper extent being telescopically received within the lower extent to afford adjustability to the center post, the upper end having approximately a 90 degree bend, the lower end including a weighed base portion, two opposed resilient clips positioned intermediate the upper and lower ends of the center post;

a backboard having a front face and a rear face, a basketball net secured to the front face of the backboard, the rear face of the backboard secured to the upper end of the center post;

a first and a second linkage, each linkage including a first link having two parallel extents and an intermediate perpendicular extent therebetween, a second downwardly extending link, and a third ground engaging link having a distal end, the first link being pivotally secured to the second link and the second link being pivotally secured to the third link, the first link of the first linkage being pivotally secured to the center post below the opposing clips, the first link of the second linkage being pivotally secured to the center post below the opposing clips and opposite the first link of the first linkage, a net secured inbetween the first and second linkages, each linkage having a first orientation wherein the first link is approximately perpendicular to the center post and the third link engages the ground with the distal end of the third linkage positioned beneath the weighted base, and a second orientation wherein the first link is secured to one of the opposed clips and approximately parallel to the center post.

2. A sporting net for use in conjunction with both basketball and hockey, the net comprising in combination:

a center post having an upper extent with an upper end and a lower extent with a lower end, the upper end having approximately a 90 degree bend, the lower end including a weighed base portion;

a backboard having a front face and a rear face, a basketball net secured to the front face of the backboard, the rear face of the backboard secured to the upper end of the center post;

a first and second linkage, a net secured in between the first and second linkages, each of the linkages having a first use orientation and a second storage orientation, the first and second linkage being disposed on the lower extent of the center post whereby when in the first use orientation the first and second linkage abut a recipient surface.

3. The sporting net as described in claim 2 further comprising:

two opposed resilient clips positioned intermediate the upper and lower ends of the center post; and wherein each linkage includes a first link having two parallel extents and an intermediate perpendicular extent therebetween, a second downwardly extending link, and a third ground engaging link having a distal end, the first link being pivotally secured to the second link and the second link being pivotally secured to the third link, the first link of the first linkage being pivotally secured to the center post below the opposing clips, the first link of the second linkage being pivotally secured to the center post below the opposing clips and opposite the first link of the first linkage.

4. The sporting net as described in claim 2 wherein:

the upper extent of the center post is telescopically received within the lower extent of the center post to afford adjustability to the center post.

* * * * *